US009033377B2

(12) United States Patent
Day et al.

(10) Patent No.: US 9,033,377 B2
(45) Date of Patent: May 19, 2015

(54) MAGNETIC LATCH FOR SAFETY APPLICATIONS WITH ADJUSTABLE HOLDING FORCE

(75) Inventors: Anthony Day, Manchester (GB); Derek W. Jones, Galloway (GB)

(73) Assignee: Rockwell Automation Limited, Maldon Essex (GB)

( * ) Notice: Subject to any disclaimer, the term of this patent is extended or adjusted under 35 U.S.C. 154(b) by 425 days.

(21) Appl. No.: 13/492,358

(22) Filed: Jun. 8, 2012

(65) Prior Publication Data

US 2013/0049382 A1 Feb. 28, 2013

Related U.S. Application Data

(60) Provisional application No. 61/526,479, filed on Aug. 23, 2011.

(51) Int. Cl.

| | |
|---|---|
| ***E05C 19/16*** | (2006.01) |
| ***E05B 17/00*** | (2006.01) |
| *E05B 47/00* | (2006.01) |

(52) U.S. Cl.

CPC ..... *E05C 19/16* (2013.01); *E05B 17/002* (2013.01); *E05B 2047/0068* (2013.01)

(58) Field of Classification Search

CPC E05B 17/002; E05B 2047/0068; E05C 19/16
USPC ..... 292/251.5, 340, 341.15; 70/276, 413; 256/1, 73

See application file for complete search history.

(56) References Cited

U.S. PATENT DOCUMENTS

| | | | | |
|---|---|---|---|---|
| 2,958,355 | A * | 11/1960 | Young | 30/123.5 |
| 3,050,324 | A * | 8/1962 | Faber | 292/251.5 |
| 3,287,051 | A * | 11/1966 | Anderson | 292/251.5 |
| 3,539,214 | A * | 11/1970 | Fisher | 292/251.5 |
| 5,362,116 | A * | 11/1994 | Doyle et al. | 292/144 |
| 2008/0211238 | A1 * | 9/2008 | Stevens | 292/163 |
| 2009/0140858 | A1 * | 6/2009 | Gore et al. | 340/547 |

* cited by examiner

*Primary Examiner* — Kristina Fulton
*Assistant Examiner* — Christine M Mills
(74) *Attorney, Agent, or Firm* — Boyle Fredrickson, S.C.

(57) ABSTRACT

A magnetic latch for industrial environments includes fixed magnetic pole pieces that may be sealed within a housing to resist environmental contamination and which provide for perpendicular engagement faces for use with gates having a rolling or swinging configuration. An RFID tag reader may be incorporated into the magnet assembly of the latch for reading a specially encoded RFID tag in a keeper portion of the magnetic latch.

17 Claims, 8 Drawing Sheets

MAGNETIC LATCH FOR SAFETY APPLICATIONS WITH ADJUSTABLE HOLDING FORCE

CROSS REFERENCE TO RELATED APPLICATION

This application claims the benefit of U.S. provisional application 61/526,479 filed Aug. 23, 2011 and hereby incorporated in its entirety by reference.

BACKGROUND OF THE INVENTION

The present invention relates to safety equipment, and in particular, to a magnetic latch and switch combination highly resistant to generating false "door closed" signals and that may be flexibly employed in a variety of safety situations.

Many industrial processes present risks to human operators during one or more operating phases. These risks may be reduced through the use of "safety systems" which provides specialized computers and sensors that help ensure the safety of human operators in such environments.

The safety system may monitor operation of the industrial process and detect risk to human operators within a risk zone at certain times during that process by monitoring or controlling the position of the human operators through the use of various sensing systems and barricades. Common sensor systems include pressure mats and light curtains. Highest security is provided by mechanical barriers, such as gates having switches indicating whether the gate is open and access to the risk zone is possible.

In the latter case, it is important that the switches on such gates be highly resistant to failures that incorrectly indicate that the gate is closed when the gate is open, whether the failure is caused by normal wear, damage, environmental contamination, or tampering.

One method of producing such reliable switches employs a "radio-frequency identification" RFID tag positioned on one component of the gate and an RFID tag sensor on another component of the gate, such that the sensor and tag are separated when the gate is open. Positive indication of gate closure requires not only detection of proximity of the RFID tag (which may only be sensed at close ranges) but that a numeric code embedded in the RFID tag be the correct numeric code for the gate, preventing tampering through the use of different RFID tags.

Ideally, this RFID sensor system might be incorporated into a latch used to hold the gate closed to be automatically positioned near to elements of the gate which separate when the gate is opened. The wide variety of different types of latches intended for gates of different sizes dimensions and operation, make incorporating an RFID sensor system into the latch difficult.

SUMMARY OF THE INVENTION

The present invention provides an extremely versatile latch system incorporating RFID sensing. The latch is a magnetic style latch that may work in a large variety of different gate holding applications and in contaminating environments. In some embodiments, the latch is configured to permit use for both rolling or swinging gate configurations and the latching-force of magnetic attraction provided by the latch may be adjusted.

Specifically then, the present invention provides a magnetic latch for safety applications having a magnet assembly providing a housing presenting a mounting surface for attaching the housing to a gate, the housing holding a permanent magnet flanked by ferromagnetic pole pieces extending out of the housing. A keeper plate of ferromagnetic material provides a first and second area displaced from each other each with different magnetic permeability and each sized to receive the ferromagnetic pole pieces thereagainst.

It is thus a feature of at least one embodiment of the invention to permit adjustment of the magnetic attraction force between the magnet assembly and the keeper plate permitting versatile use of a single latch design in multiple safety applications.

The keeper plate may have a series of holes in the ferromagnetic material in the first area decreasing its average permeability with respect to the second area.

It is thus a feature of at least one embodiment of the invention to provide a simple method of changing the permeability of a mechanically integrated ferromagnetic plate.

The holes may be filled with a nonmetallic material.

It is thus a feature of at least one embodiment of the invention to provide a method of controlling permeability that is easy to manufacture and resistant to environmental contamination.

The keeper plate may be overmolded with a polymer material outside of the first and second areas.

It is thus a feature of at least one embodiment of the invention to provide a simple method of incorporating an RFID tag into a magnetic keeper plate through an over molding encapsulation.

The pole pieces may be fixed with respect to the housing and sealed at a point of exit from the housing.

It is thus a feature of at least one embodiment of the invention to provide a magnetic latch that is better resistant to environmental contamination.

The housing may provide a cantilevered portion extending from the mounting surface in a direction of egress of the pole pieces from the housing.

It is thus a feature of at least one embodiment of the invention to provide a housing form factor that permits application to a variety of different gate configurations including rolling or sliding gates and swinging or hinging gates.

The ferromagnetic pole pieces may extend in a direction perpendicular to the mounting surface out of the cantilevered portion and extend in a direction parallel to the mounting surface out of the cantilevered portion.

It is thus a feature of at least one embodiment of the invention to provide magnetic latching surfaces suited for different gate configurations.

The housing may further hold an RFID reader and the keeper plate may hold an RFID tag.

It is thus a feature of at least one embodiment of the invention to provide a highly secure gate switch for use in industrial environments.

These particular objects and advantages may apply to only some embodiments falling within the claims and thus do not define the scope of the invention.

DETAILED DESCRIPTION OF THE PREFERRED EMBODIMENT

Figure 1:
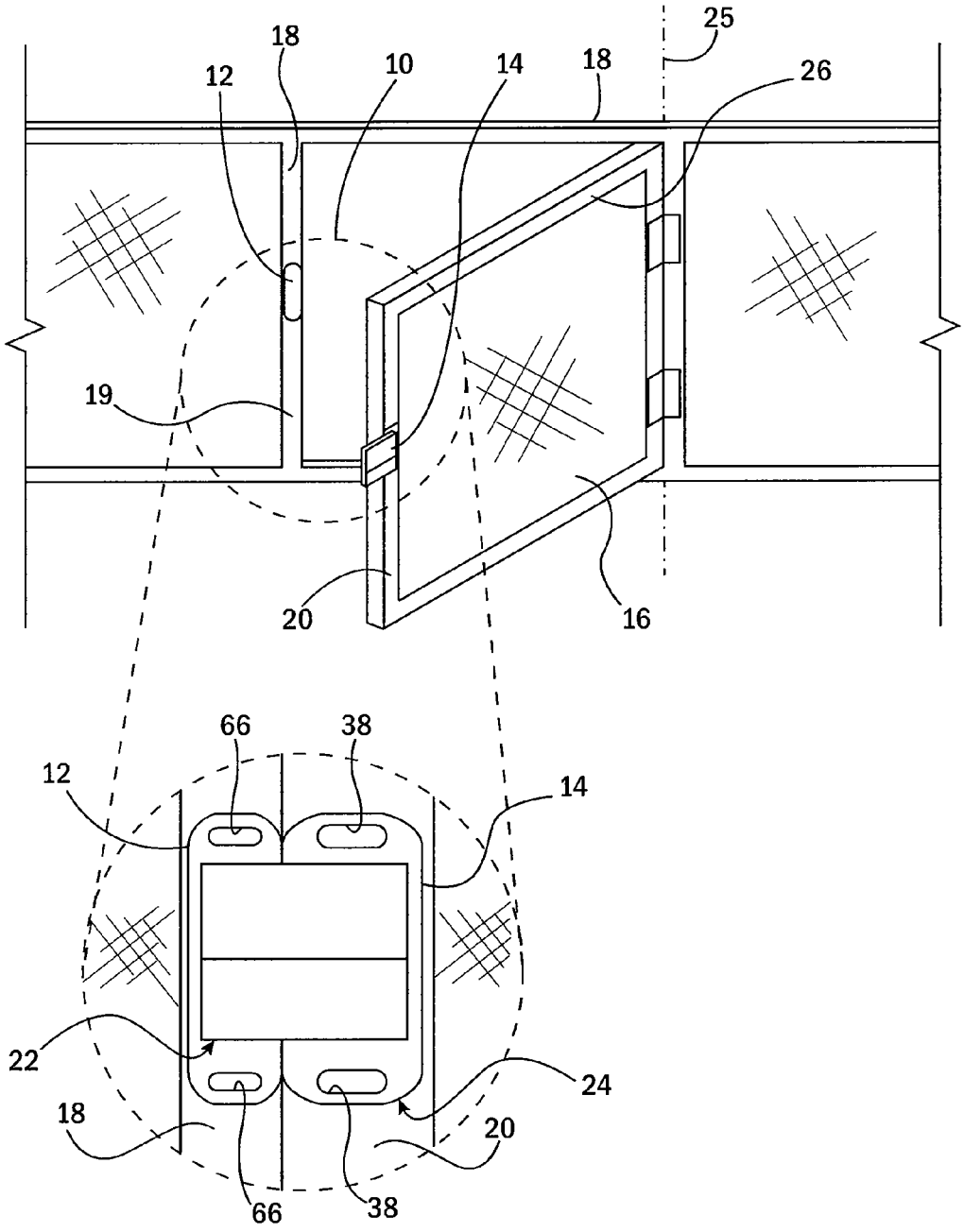
FIG. 1 is a fragmentary perspective view of the magnetic latch of the present invention, including a magnet assembly and keeper plate as installed on a hinging-style gate.

Referring now to FIG. 1, a magnetic latch 10 of the present invention may provide for a separate, interengaging keeper plate 12 and magnet assembly 14 that may be attached to different respective portions of an openable gate 16 and a supporting gate frame 18.

As depicted, the keeper plate 12 may be attached to a front surface of a vertical stationary stile 19 of the supporting gate frame 18 and the magnet assembly 14 may be attached to a movable edge 20 of the swinging gate 16, the swinging gate 16 pivoting generally about a vertical axis 25 located at an edge of the gate 16 opposite a vertically extending movable edge 20. When the gate 16 is open, the keeper plate 12 and magnet assembly 14 are separated and when the gate 16 is closed, the keeper plate 12 and magnet assembly 14 are inter-engaging.

Figure 7:
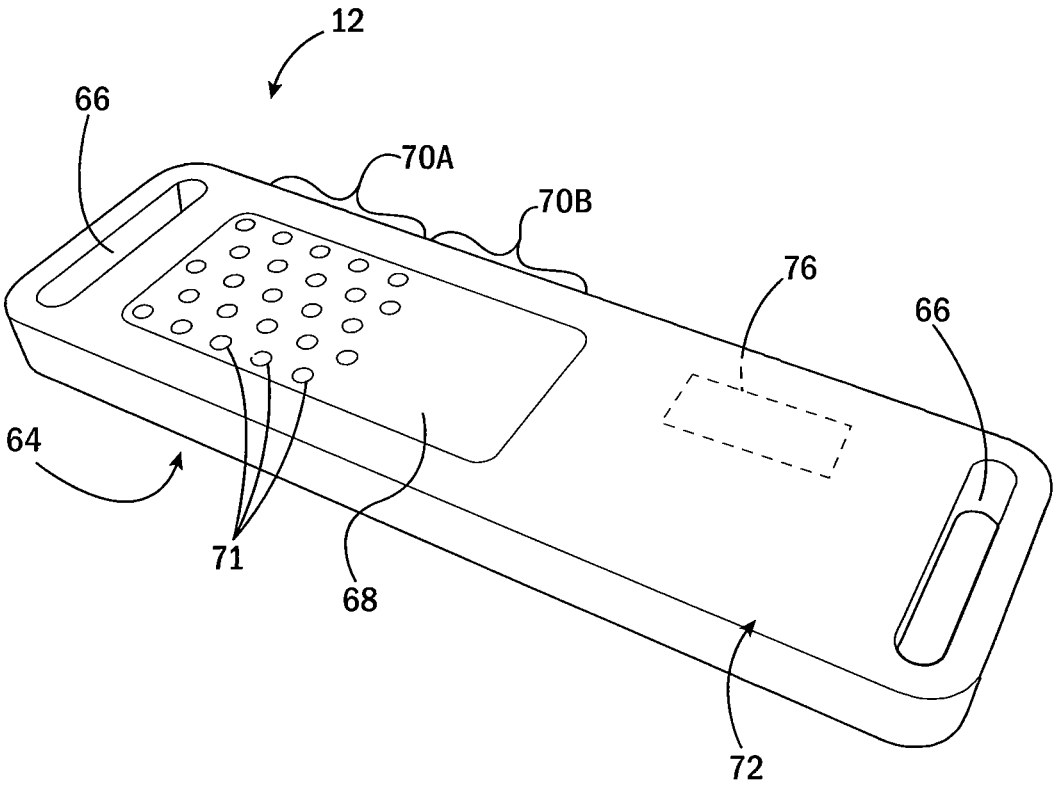
FIG. 7 is a perspective view of the keeper plate showing the first and second areas.
Figure 8:
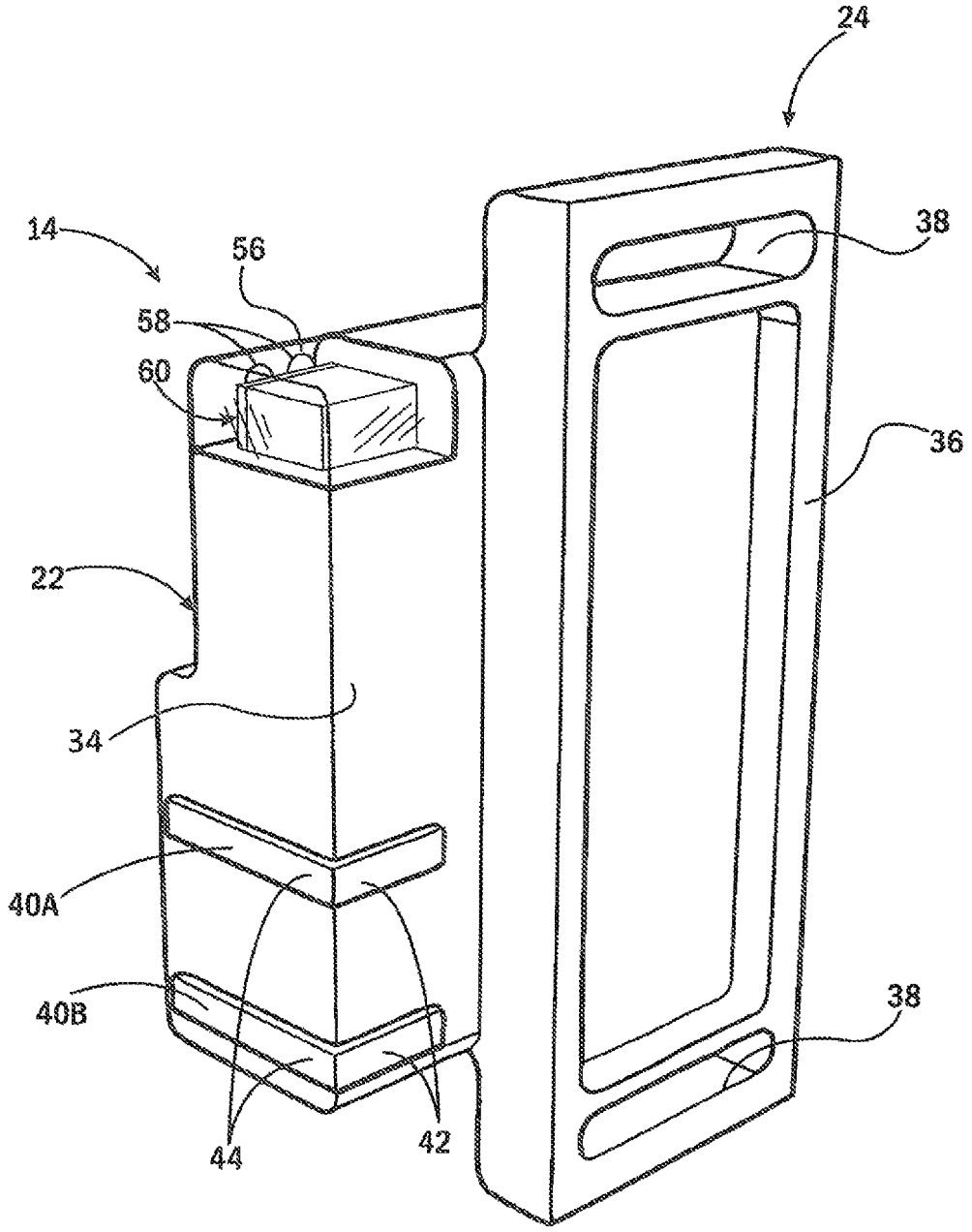
FIG. 8 is a perspective view of the magnet assembly showing to perpendicular surfaces for hinging-style or rolling-style door operation.

Referring to FIGS. 1, 7 and 8, the magnet assembly 14 may have a rear mounting surface 36 which may abut and be attached to a front surface of the movable edge 20 and the keeper plate 12 may have a rear surface 64 that may abut and the attached to a front edge of the stationary stile 19. When the gate 16 is closed, and the magnet assembly 14 and keeper plate 12 are inter-engaging, the front edges of the movable edge 20 and stationary stile 19 may be adjacent and parallel. In this state, a portion 22 of the magnet assembly 14 will extend over a front surface of the keeper plate 12 in cantilevered fashion, and a rear surface of the magnet assembly 14 will abut the front surface of the keeper plate 12.

Figure 2:
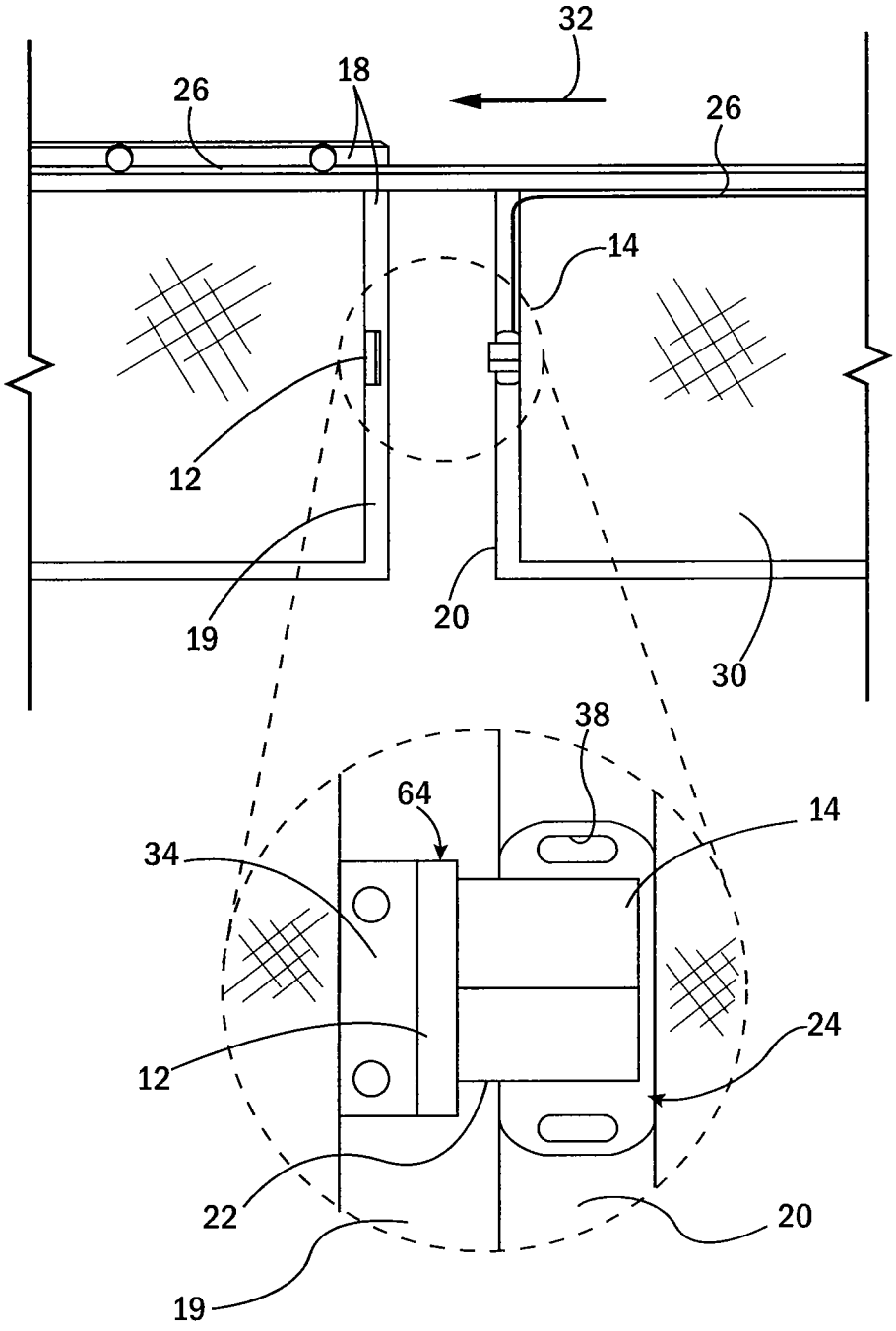
FIG. 2 is a figure similar to that of FIG. 1 showing the magnetic latch as installed on a rolling-style gate.

An electrical cable 26 may extend from the magnet assembly 14 to carry signals from and power to a RFID tag reader (to be described below) contained in the magnet assembly 14. The signals may be provided to a remote industrial control system (not shown) managing a safety protocol Referring now to FIG. 2, in an alternative configuration, the magnet assembly 14 may be mounted on a stationary stile 19 of a gate frame 18 so that movable edge 20 of the gate 30 may approach stationary stile 19 of the gate frame 18 along a linear trajectory 32. In this case, the magnet assembly 14 is mounted with its rear mounting surface 24 against a front surface of the stationary stile 19. The keeper plate 12 maybe rotated 90 degrees to extend perpendicularly from the front face of the movable edge 20 as held by a support block 34. Thus, when the gate 30 is closed against the gate frame 18 with the movable edge 20 abutting the stationary stile 19 and their front face is substantially coplanar, a side surface of the cantilevered portion 22 of the magnet assembly 14 abuts the front surface of the keeper plate 12. Again, a cable 26 may extend from the magnet assembly 14 to carry signals from and power to a RFID tag reader to a remote industrial control system.

Referring again to FIG. 8, the mounting surface 24 of the magnet assembly 14 may present a relatively planar rear mounting surface 36 flanked by slotted holes 38 allowing the mounting surface 36 to be attached to a planar surface of the movable edge 20 or stationary stile 19 and retained there by machines screws or the like, while permitting horizontal adjustment (as depicted). The cantilevered portion 22 has a rear overhang surface 39 displaced forward with respect to the mounting surface 36 to be removed from the movable edge 20 or stile 19 and to extend help therefrom. Pole pieces 40*a* and 40*b* project from the cantilevered portion 22 to provide for rear engaging surfaces 42 on a rear face of the cantilevered portion 22 and side engaging surfaces 44 on a side face of the cantilevered portion. The rear engaging surfaces 42 may engage corresponding surfaces of the keeper plate 12 in the configuration shown in FIG. 1 and the side engaging surfaces 44 may engage corresponding surfaces of the keeper plate 12 in the configuration shown in FIG. 2.

Figure 3:
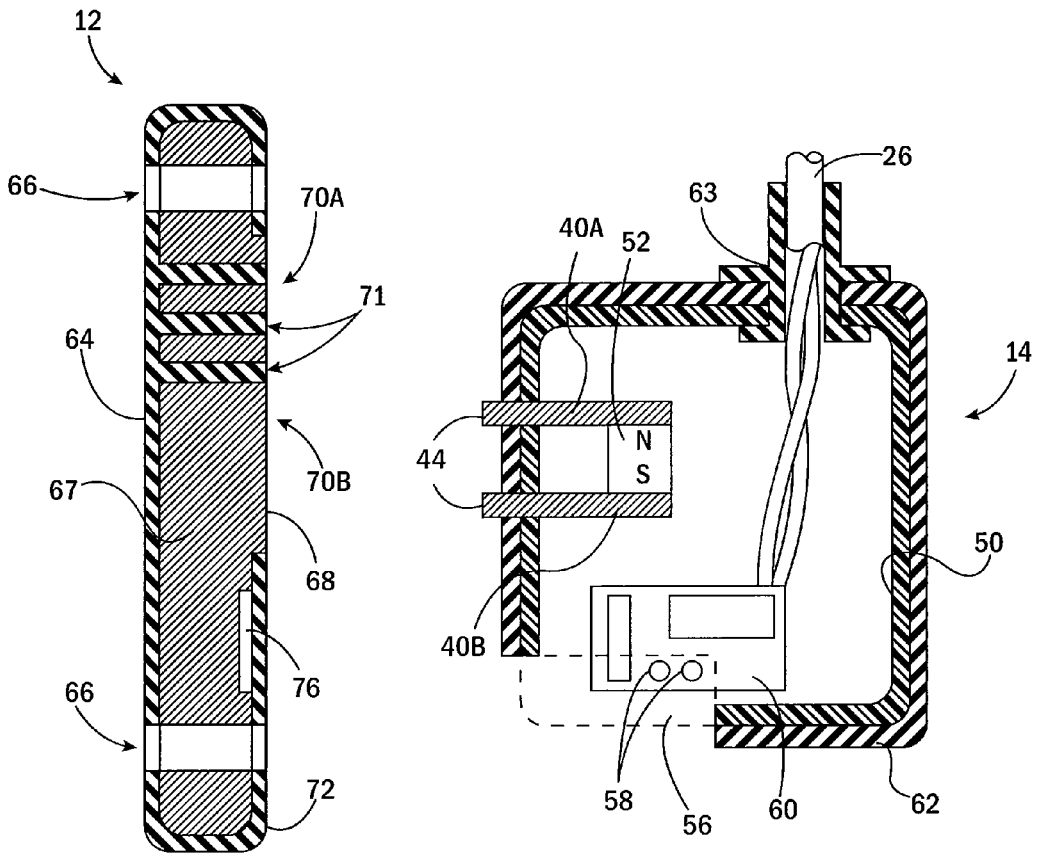
FIG. 3 is a cross-sectional view of the magnet assembly and keeper plate of the magnetic latch of the present invention, along a vertical plane as positioned in opposition for a rolling-style gate of FIG. 2 showing a permanent magnet internal to a housing of the magnet assembly having flanking pole pieces extending outside of the housing and sealed with respect to the housing with an internal RFID reader, and showing a ferromagnetic bar of the keeper plate with cylinders of non-ferrous material in one section for reducing magnetic attraction as overmolded with a polymer retaining an internal RFID tag.

Referring now generally to FIGS. 3 and 8, the magnet assembly 14 may include a housing 50, for example, constructed of a non-ferromagnetic metal or high-strength thermoplastic holding therein a permanent magnet 52, for example, a rare earth magnet. The magnet 52 may be flanked by generally planar and rectangular ferromagnetic pole pieces 40*a* and 40*b* that serve to conduct the flux of the magnet 52 from inside the housing 50 to outside of the housing 50 through a housing wall. Outside the housing wall, the pole pieces 40*a* and 40*b* provide the exposed rear engaging surfaces 42 and side engaging surfaces 44 of the pole pieces 40 described above.

The housing 50 may include a transparent portion 56 through which may be viewed indicator lights 58 of an RFID reader 60 contained in the housing 50.

The outer surface of the housing 50 may be sealed, for example, with an overmolded polymer material 62 preventing the ingress of contaminants into the housing 50. Electrical cable 26, providing power to and signals from the RFID reader 60, may pass through a grommet 63 through the housing 50 and thereby be sealed as well.

Referring now generally to FIGS. 3 and 7, the keeper plate 12 may provide for a generally rectangular form providing a rear surface 64 that may be mounted against a support surface. The rear surface 64 may be flanked by slotted holes 66 extending generally across the longest dimension of the keeper plate 12 and generally parallel to the slotted holes 38 of the magnet assembly 14 in the mounting system of FIG. 1, allowing the proximity of the two to be freely adjusted.

The keeper plate 12 may include a ferromagnetic core 67, for example, a martensitic stainless steel material having a plateau portion 68 rising from its front surface and presenting a first area 70*a* and second area 70*b*, either of which may be engaged by the pole pieces 40*a* and 40*b* depending on the relative alignment between the magnet assembly 14 and the keeper plate 12. The outer surface of the keeper plate 12 may be overmolded with a polymer material 72 similar to polymer material 62 used with the magnet assembly 14

The first area 70*a* may be perforated by a series of holes 71 filled with the overmolded material and the second area 70*b* may be free of such perforations. As will be described below, depending on the alignment of the pole pieces 40*a* and 40*b* with the first area 70*a* or the second area 70*b* different levels of magnetic attraction may be obtained.

An RFID tag 76 may fit within a pocket on the front surface of the ferromagnetic core 67 to be readable by the RFID reader 60 for all relative orientations of the magnet assembly 14 and keeper plate 12.

Figure 4A:
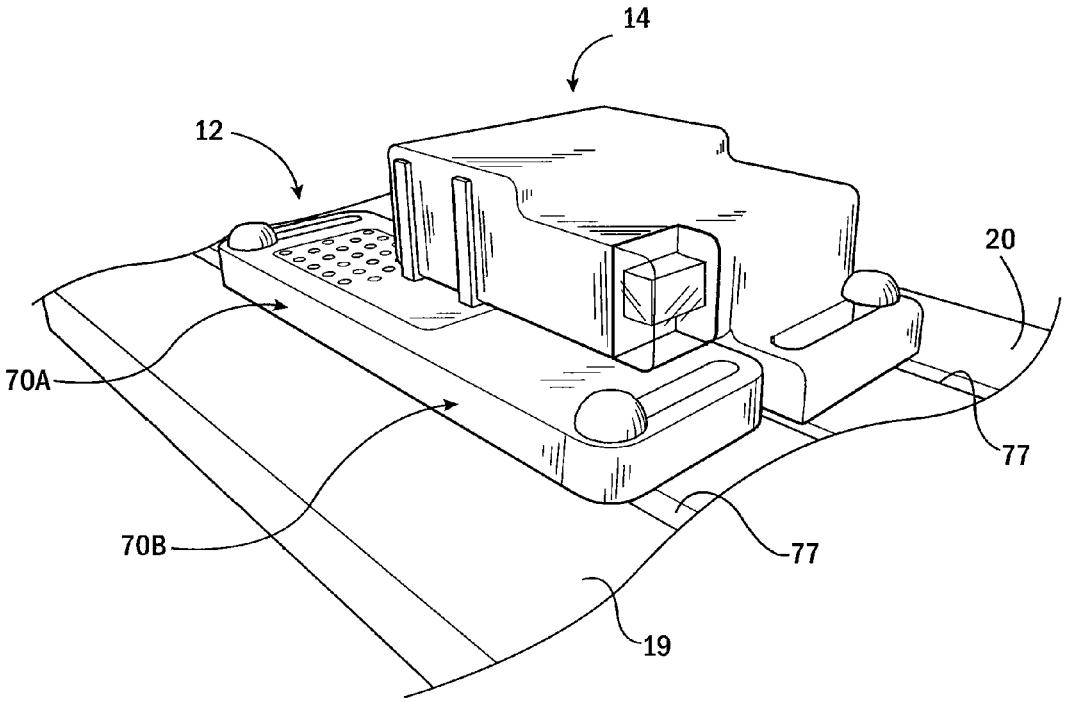
FIGS. 4*a* and 4*b* are respectively a perspective view of the magnet assembly and keeper plate in a first orientation for maximum magnetic attraction, and a fragmentary vertical cross-section through the pole pieces of the magnet assembly showing conduction of magnetic flux lines through a first area of the keeper plate for maximum magnetic attraction.
Figure 4B:
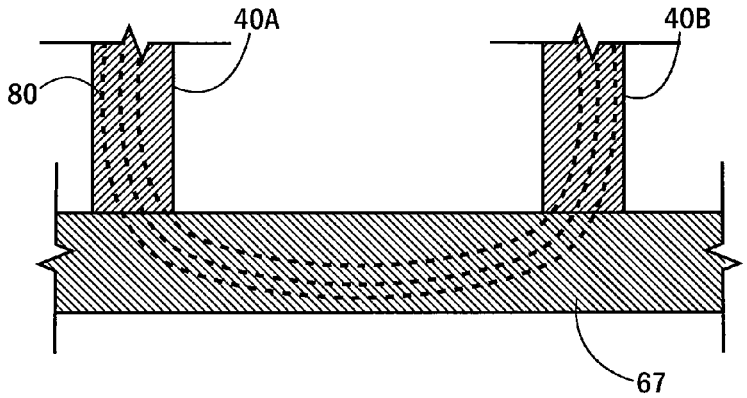

Referring now to FIGS. 4*a* and 4*b*, a high degree of magnetic attraction between the magnet assembly 14 and keeper plate 12 may be attained by aligning the pole pieces 40*a* and 40*b* to both abut the second area 70*b*. In this orientation magnetic flux 80 between the pole pieces 40 is largely contained within the ferromagnetic core 67 increasing the flux density and hence magnetic attractive force between the pole pieces 40 and the ferromagnetic core 67.

Figure 5A:
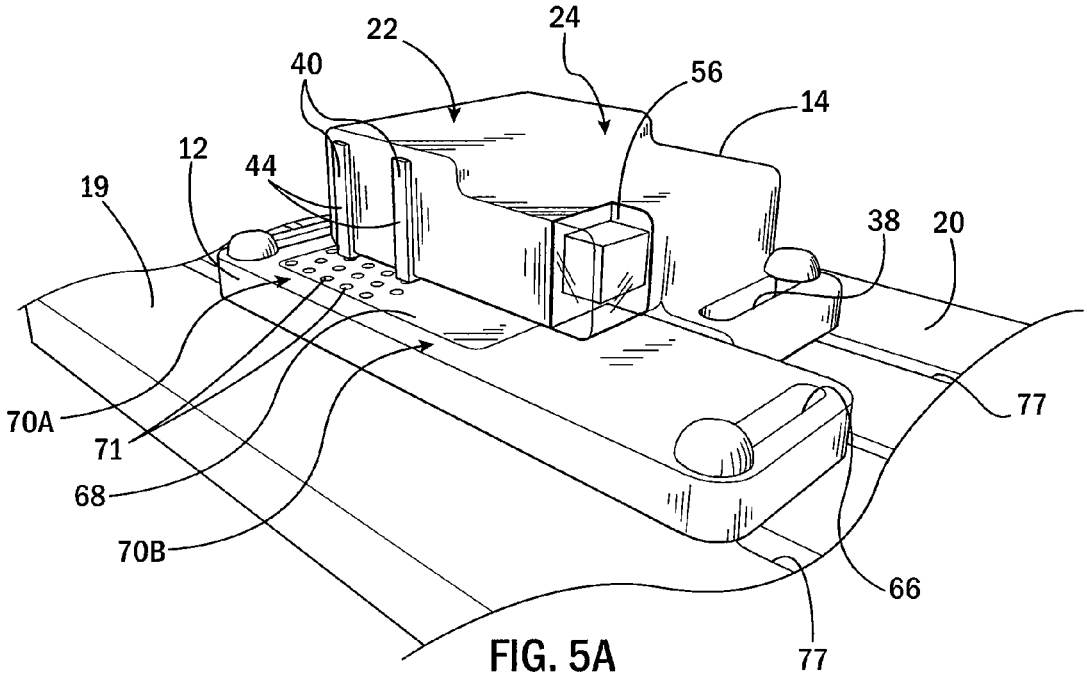
FIGS. 5*a* and 5*b* are figures similar to that of FIGS. 4*a* and 4*b* showing positioning of the magnet assembly and keeper plate in a second configuration for intermediate magnetic attraction.
Figure 5B:
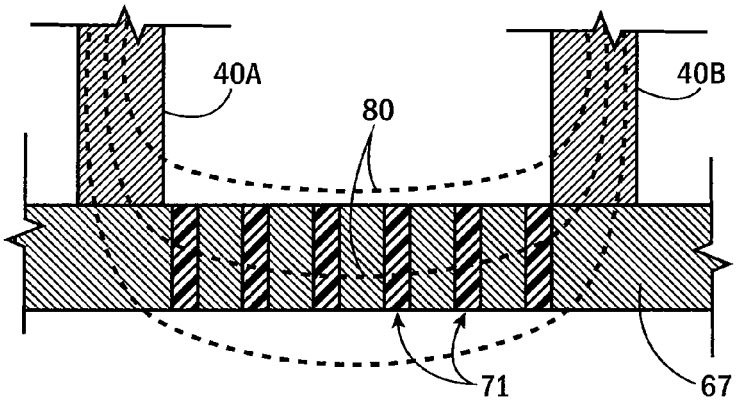

Referring to FIGS. 5*a* and 5*b*, conversely a low degree of magnetic attraction between the magnet assembly 14 and keeper plate 12 may be obtained by aligning the pole pieces 40*a* and 40*b* to both abut the first area 70*a*. In this orientation, magnetic flux between the pole pieces 40 is not fully contained within the ferromagnetic core 67 decreasing the flux density and magnetic attractive force between the pole pieces 40 and the ferromagnetic core 67.

Figure 6A:
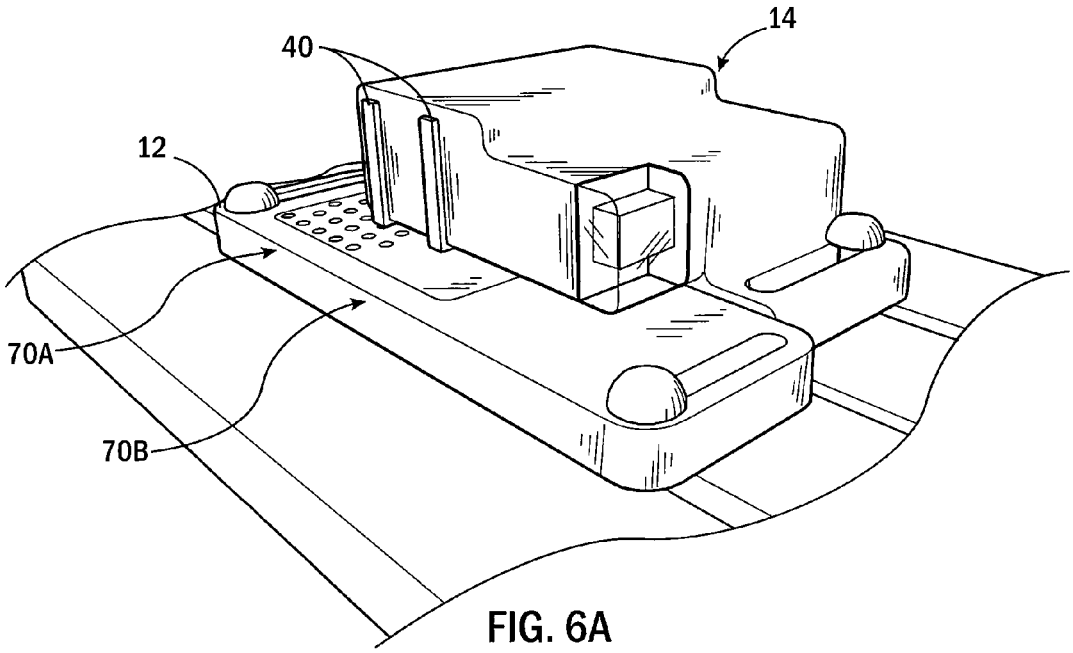
FIGS. 6*a* and 6*b* are figures similar to that of FIGS. 4*a* and 4*b* showing adjustment of the magnet assembly and keeper plate in a third configuration for minimum magnetic attraction.
Figure 6B:
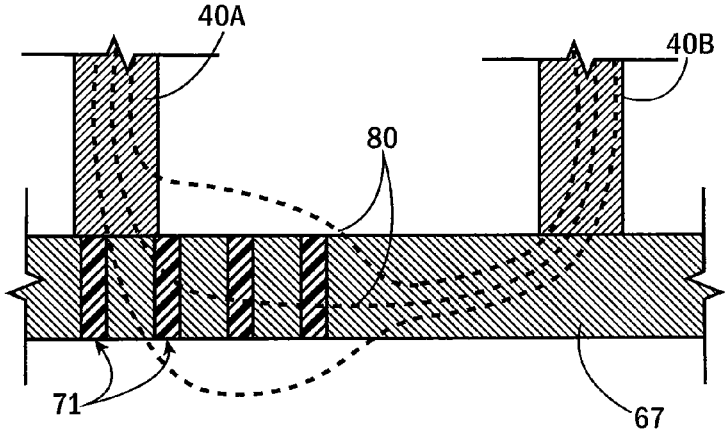

Referring to FIGS. 6*a* and 6*b*, a position halfway between the two positions of FIGS. 5 and 4 may also be employed providing an intermediate level of force in which the magnetic flux 80 is only partially contained in the ferromagnetic core 67 as they pass between pole pieces 40.

In these figures, the magnetic latch 10 is mounted on channels 77 forming the stile 19 and movable edge 20 allowing ready repositioning of the magnet assembly 14 and keeper plate 12.

Although the terms "safety", "reliable", "safety system", "safety controller", and other related terms may be used herein, the usage of such terms is not a representation that the present invention will make an industrial or other process safe or absolutely reliable, or that other systems will produce unsafe operation. Safety in an industrial or other process depends on a wide variety of factors outside of the scope of the present invention including, for example: design of the safety system; installation and maintenance of the components of the safety system; the cooperation and training of individuals using the safety system; and consideration of the failure modes of the other components being utilized. Although the present invention is intended to be highly reliable, all physical systems are susceptible to failure and provision must be made for such failure.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A magnetic latch for safety applications comprising:

a magnet assembly providing a housing presenting a mounting surface extending along a first plane for attaching the housing to a gate, the housing holding a permanent magnet flanked by two sets of ferromagnetic pole pieces extending out of the housing in mutually perpendicular directions to provide a first and second magnetic engagement surfaces;

a keeper plate of ferromagnetic material having a first and second areas displaced from each other, each with different magnetic permeability and each sized to receive the ferromagnetic pole pieces thereagainst; and whereby different degrees of magnetic attraction force between the magnet assembly and the keeper plate may be obtained by changing an alignment of the magnet assembly and keeper plate to change which of the first and second areas receive the ferromagnetic pole pieces;

wherein the housing provides a cantilevered portion projecting in a direction parallel to and displaced from the first plane so that a set of ferromagnetic pole pieces extends out of the cantilevered portion in a direction toward and perpendicular to the first plane.

2. The magnetic latch of claim 1 wherein the keeper plate has a series of holes in the ferromagnetic material in the first area decreasing the average permeability of the keeper plate with respect to the second area.

3. The magnetic latch of claim 2 wherein the holes are filled with a nonmetallic material.

4. The magnetic latch of claim 1 wherein the keeper plate is overmolded with a polymer material outside of the first and second areas.

5. The magnetic latch of claim 1 wherein the ferromagnetic pole pieces are fixed with respect to the housing and sealed at a point of exit from the housing.

6. The magnetic latch of claim 1 wherein the housing further includes a radio frequency identification (RFID) reader.

7. The magnetic latch of claim 1 wherein the keeper plate includes a radio frequency identification (RFID) tag.

8. The magnetic latch of claim 7 wherein the RFID tag is overmolded with polymer.

9. A method of providing a latched gate using a magnetic latch having:

a magnet assembly providing a housing presenting a mounting surface extending along a first plane for attaching the housing to a gate, the housing holding a permanent magnet flanked by two sets of ferromagnetic pole pieces extending out of the housing in mutually perpendicular directions to provide a first and second magnetic engagement surfaces;

a keeper plate of ferromagnetic material having a first and second areas displaced from each other and each sized to receive the ferromagnetic pole pieces thereagainst;

wherein the housing provides a cantilevered portion projecting in a direction parallel to and displaced from the first plane so that a set of ferromagnetic pole pieces extends out of the cantilevered portion in a direction toward and perpendicular to the first plane the method comprising the steps of:

attaching one of the magnet assembly and keeper plate to a stationary portion of the gate and the other of the magnet assembly and keeper plate to a movable portion of the gate which moves away from the stationary portion of the gate when the gate is open, the attaching including the step of adjusting alignment of the magnet assembly and keeper plate to change which of the first and second areas receive the ferromagnetic pole pieces and thereby control a force of attraction between the magnet assembly and keeper plate.

10. The method of claim 9 wherein the keeper plate has a series of holes in the ferromagnetic material in the first area decreasing the average permeability of the keeper plate with respect to the second area.

11. The method of claim 10 wherein the holes are filled with a nonmetallic material.

12. The method of claim 9 wherein the keeper plate is overmolded with a polymer material outside of the first and second areas.

13. The method of claim 9 wherein the ferromagnetic pole pieces are fixed with respect to the housing and sealed at a point of exit from the housing.

14. The method of claim 9 wherein one set of ferromagnetic pole pieces extend in a direction perpendicular to the mounting surface out of the cantilevered portion and one set of ferromagnetic pole pieces extend in a direction parallel to the mounting surface out of the cantilevered portion.

15. The method of claim 9 wherein the housing further includes a radio frequency identification (RFID) reader.

16. The method of claim 9 wherein the keeper plate includes a radio frequency identification (RFID) tag.

17. The method of claim 15 wherein the RFID tag is overmolded with polymer.

* * * * *